United States Patent [19]

Saegusa

[11] Patent Number: 4,662,204

[45] Date of Patent: May 5, 1987

[54] APPARATUS FOR AUTOMATICALLY BENDING METALLIC TUBES

[75] Inventor: Shigeru Saegusa, Shizuoka, Japan

[73] Assignee: Usui Kokusai Sangyo Kabushiki Kaisha, Shizuoka, Japan

[21] Appl. No.: 818,620

[22] Filed: Jan. 13, 1986

[30] Foreign Application Priority Data

Jan. 17, 1985 [JP] Japan ..... 60-6591
Jan. 28, 1985 [JP] Japan ..... 60-13769

[51] Int. Cl.[4] ..... B21D 7/024

[52] U.S. Cl. ..... 72/306; 72/384; 72/422; 269/61; 269/234; 414/763; 414/917

[58] Field of Search ..... 72/306, 307, 321, 323, 72/384, 422; 269/58, 61, 238, 234, 217; 414/763, 783, 917; 901/15

[56] References Cited

U.S. PATENT DOCUMENTS 2,871,909 2/1959 Bower ..... 72/321
3,262,593 7/1966 Hainer ..... 901/15
4,199,294 4/1980 Streck et al. ..... 269/61
4,221,953 9/1980 Kiilunen ..... 901/15

FOREIGN PATENT DOCUMENTS 1458556 11/1966 France ..... 72/384
57864 5/1979 Japan ..... 414/783

*Primary Examiner*—Daniel C. Crane
*Attorney, Agent, or Firm*—Anthony J. Casella; Gerald E. Hespos

[57] ABSTRACT

An apparatus is provided for automatically bending tubular materials. The apparatus comprises a bending direction setter which is operative to securely grip a length of tubular material approximately centrally along the length of material. The bending direction setter is operative to rotate the tubular material about its original axis a preselected and carefully controlled amount. The bending apparatus further comprises a pair of automatic benders which are operative to engage the tubing at selected locations on opposed sides of the bending direction setter. The benders are operative to selectively engage the tubing material at a predetermined location therealong and to effect a controlled bend therein. The bending direction setter may rotate the tubular material about its original axis between successive bends carried out by the benders, thereby enabling the tubular material to be bent through three dimensions. The apparatus further comprises a takeout unit for removing the bent tubular product from the bend direction setter.

6 Claims, 5 Drawing Figures

APPARATUS FOR AUTOMATICALLY BENDING METALLIC TUBES

BACKGROUND OF THE INVENTION

The present invention relates to an automatic metallic tube bending process and an apparatus therefor, which have a function to automatically set the bending direction, angle and position in association with the three-dimentional bending operations of a metallic tube of a relatively small diameter such as about 20 mm or less, which is frequently arranged and used as a supply passage of oil or air generally in automobiles or in a variety of machines or facilities.

In the automatic metallic tube bending process and apparatus of the above-specified kind according to the present invention, a straight tube to be worked is automatically bent suquentially in the three-dimentional bending directions in its set state, in which its one end is clamped merely by means of a chuck, in accordance with the order from the closest one of the bending positions to the chuck and positioned in advance for the bending operations by a plurality of bending units which are connected to their respective cylinder actuators and each of which is equipped with a shaping roll and a bending roll at its leading end portion arranged in a complex manner on a frame. According to these conventional process and apparatus, however, the straight tube is set by having its one end clamped so that its other end is swung in a large stroke, if it is long, when in the bending operations. At the same time, because of the complicated structure of the plural automatic bending units which are arranged in the number equal to the bending positions on the frame, the tube naturally has its outer circumference dented or damaged as a result of the abutting and rubbing contact with the bending units including their assosiative cylinder actuators. In addition, it is troublesome to load the bending units in the complicated arrangement with the straight tube and to take out the bent tube after the bending operations. Moreover, the productivity is drastically dropped by the sequential bending operations in which the tube is bent only from its one end. In connection with this background, still moreover, the straight tube to be bent is obliged to have its length limited so that the prior art can be applied only to a relatively short straight tube. Upon the bending work of many kinds of tubes each in a small number, there arises another troublesome problem that the aforementioned plural bending units have to be rearranged for each bending work.

SUMMARY OF THE INVENTION

In order to solve those problems of the prior art remarkably effectively, the present invention contemplates to provide an automatic metallic tube bending apparatus comprising: automatic bending-direction setting means constructed of a link member connected to and associated with external actuation control means so that it may move as a whole in a folding direction; and automatic feed unit; a pair of automatic bending units connected to external actuation control means and disposed at both the right and left sides of said link member; and an automatic take-out unit for taking out a bent tube, so that a straight tube is clamped at its middle portion by a chuck at the side of the link member and has its turns set automatically by the associated automatic functions of those means and units in association with the positioning in the bending direction for the bending operations, so that the deviations at both the ends of the straight tube upon the bending operations may be minimized by conducting the bending operations sequentially from both the ends of the straight tube, the straight tube may have its outer circumference dented and damaged in the prior art as little as possible by arranging the paired automatic bending unit in a manner to move away from the two right and left end set positions, so that the productivity may be drastically improved by all the associated automations including the loading and taking-out operations of the straight tube and by shortening the working time period through the bending operations at both the right and left ends, so that the range of application to a longer tube may be widened by releasing the limit to the length of the straight tube, so that the reassemblage in case the bending shape is different for a different product lot may be facilitated merely by exchanging a turn control member which is constructed by anchoring stopper members at a cylindrical member forming part of the apparatus, and so that the apparatus may also be applied to the bending operations of a variety of straight tubes in each small number.

According to one feature of the present invention, there is provided a process for automatically bending a metallic tube, comprising:

the first step of automatically clamping a longitudinally middle portion of a standard-length straight tube, which is carried by an automatic feed unit, in a chuck portion of a link member, which is constructed as such an automatic bending-direction setting means as is arranged upright and at a right angle with respect to the longitudinal direction of said straight tube and as is made movable in a bending direction;

the second step including the substeps of: setting the two outermost ends of said straight tube in a bending position between rolls of a pair of automatic bending units, which are arranged at both the right and left sides of said link member in said clamping state, in accordance with the movements of said automatic bending units; subsequently bending said straight tube in association with the operations of external actuation control means connected to said automatic bending units; subsequently turning said chuck portion in connection with a desired bending position in accordance with the setting of the bending direction through a displacement in a folding direction by said link member acting as said automatic bending-direction setting means in association with external actuation control means; moving said automatic bending units in association with external actuation control means; bending said straight tube again like the preceding bending operation by setting the sides of said straight tube in a desired bending position between said rolls; and subsequently bending said straight tube sequentially from the outsides thereof by repeating the turns of said chuck portion in conformity to a subsequent bending position and the movements of said automatic bending units; and the third step of taking out a bend produced by means of an automatic take-out unit after the end of all the bending operations.

According to another feature of the present invention, there is provided an apparatus for automatically bending a metallic tube, comprising:

an automatic feed unit for feeding a standard-length straight tube;

automatic bending-direction setting means including a link member having support members and upper and lower parallel beams hinged loosely to said support members, said automatic bending-direction setting means being arranged upright and at a right angle with respect to said straight tube which is set in a horizontal position in a space formed in the leading end portion of said automatic bending-direction setting means with its front side being opened, said automatic bending-direction setting means having its link member made movable in a folding direction by connecting at least one of the hinge pins to external actuation control means and turning the same, said automatic bending-direction setting means including a clamping mouth of a chuck positioned on a line joining the hinged points of said upper and lower beams and at the leading end portion of a guide wall, which is hinged to the vicinity of the middle portions of said support members in parallel with said upper and lower beams and connected to an external actuation source for sliding back and forth, for automatically clamping a longitudinally substantially middle portion of said straight tube; and a pair of automatic bending units arranged at both the right and left sides of said link member and each including a shaping roll, a bending roll adapted to revolve around said shaping roll, and a receiver fixed in the vicinity of said shaping roll, and an automatic take-out unit made movable in the right and left direction to and away from said link member 6 in association with external actuation control means and in vertical directions with respect to a set bending position for taking out a bent product after the end of all the bending operations.

According to still another feature of the present invention, there is provided an apparatus for automatically setting the bending direction of an automatic metallic tube bending apparatus, characterized: in that a parallel link member is constructed by loosely hinging the longitudinally substantially middle portions and rear end portions of upper and lower beams by means of support members; in that said link member is made movable as a whole in a folding direction in accordance with the rocking motion of the beam fixed to hinge pins, which are fixed to the leading end portions of said upper and lower beans, by arranging said link member upright and at a right angle with respect to the straight tube to be worked, which is set in a horizontal position in a space opened to the front at the side of the leading end portions of said upper and lower beams, by hinging said link member to a frame by means of said hinge pins, and by connecting at least one of said hinge pins to external actuation control means to make the former associative with the latter; in that a guide wall having a chuck at its leading end portion for clamping the longitudinally substantially middle portion of said straight tube to be set is hinged to the middle portions of said support members in parallel to said upper and lower beams; and in that the clamping mouth of said chuck is positioned on a line joining the hinge points of said upper and lower beams and is closed to forcibly clamp said straight tube by pushing said chuck by the leading end portion of a moving member which engages with said guide wall in the longitudinal direction and which is connected to external actuation source for sliding back and forth.

BRIEF DESCRIPTION OF THE DRAWINGS

Other objects, features and advantages of the present invention will become apparent from the following description taken in conjunction with the embodiment thereof with reference to the accompanying drawings, in which.

DESCRIPTION OF THE PREFERRED EMBODIMENT

Figure 1:
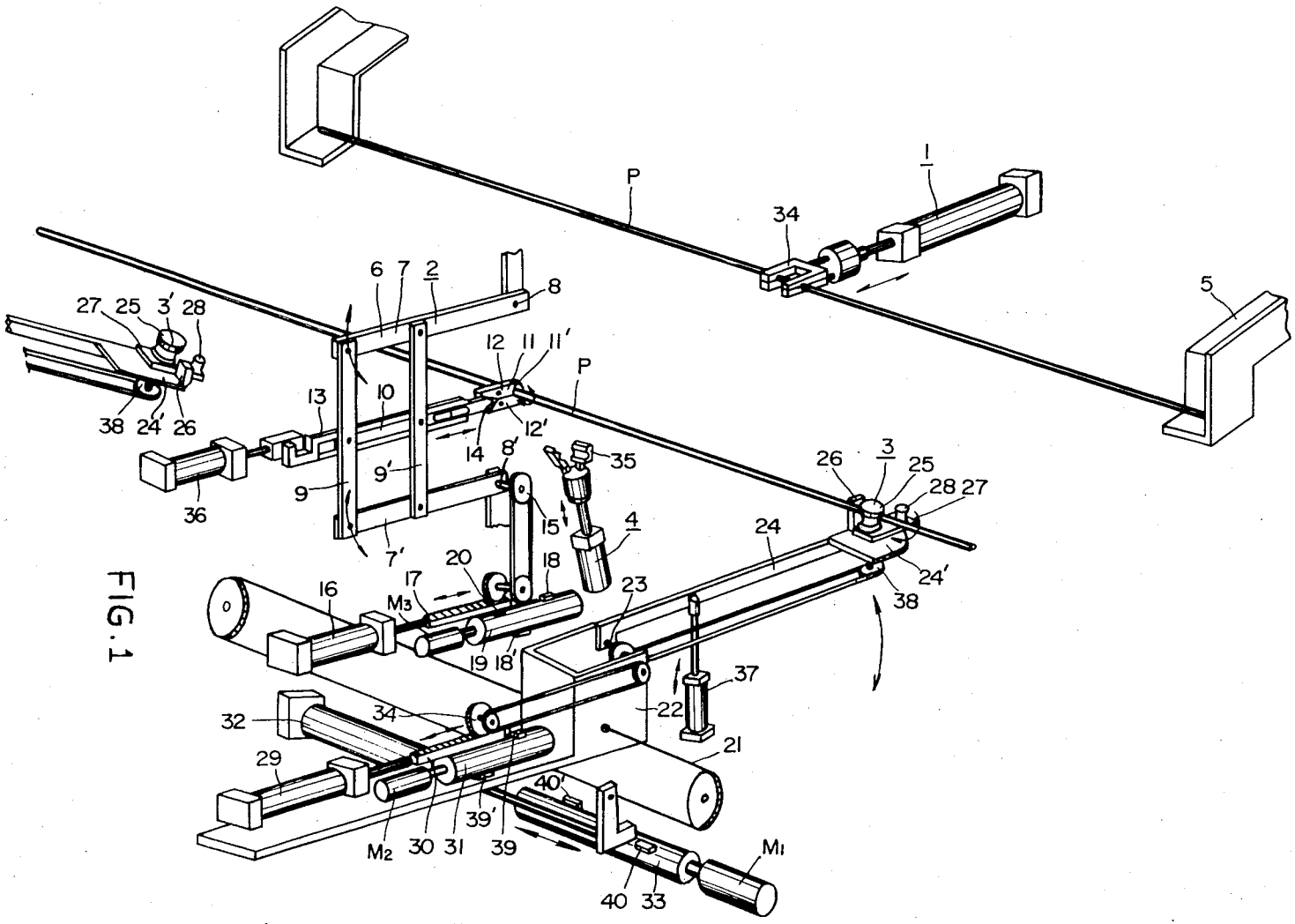
FIG. 1 is a perspective view showing a process and an apparatus for automatically bending metallic tube in accordance with one embodiment of the present invention.
Figure 2:
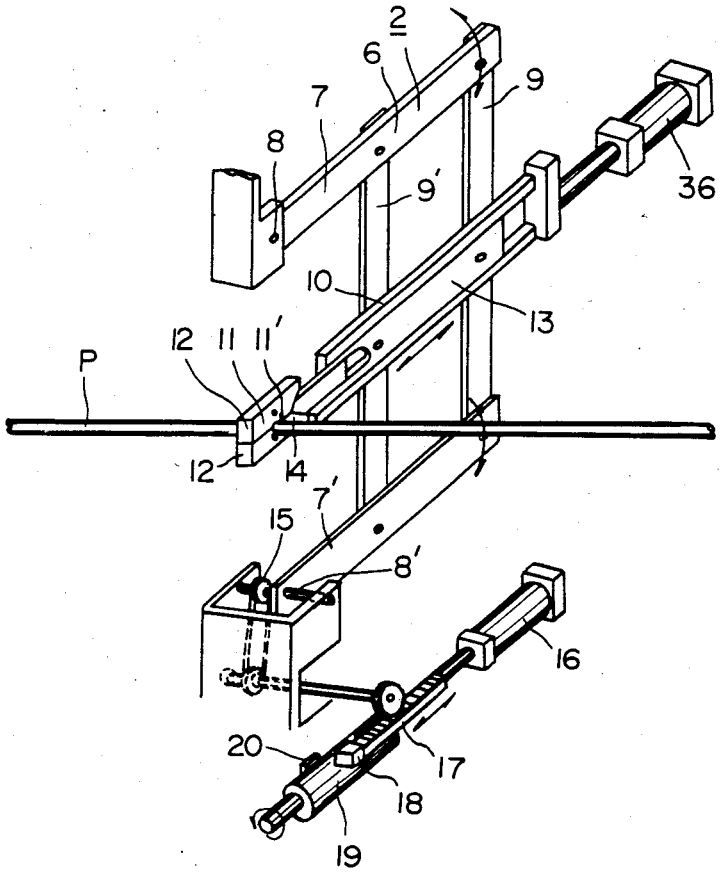
FIG. 2 is also a perspective view showing an automatic bending-direction setting apparatus.
Figure 3:
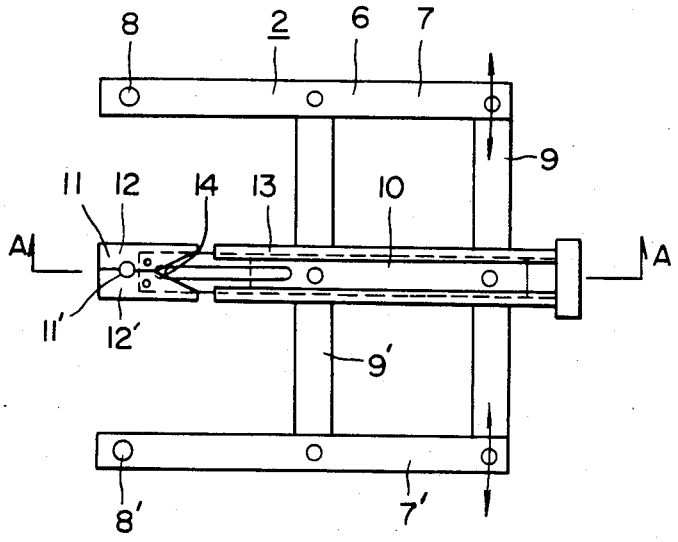
FIG. 3 is a top plan view showing a link member acting as the automatic bending-direction setting apparatus of FIG. 1.
Figure 4:
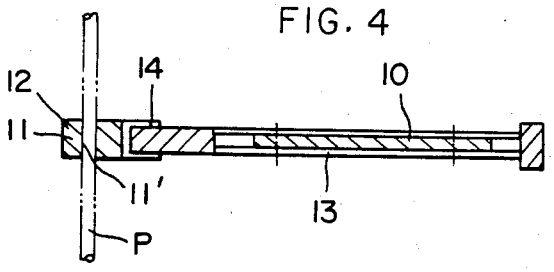
FIG. 4 is a section taken along line A—A of FIG. 3.

The present invention will be described in the following with reference to the accompanying drawings.

Indicated at reference numeral 1 is an automatic feed unit which is equipped with a chuck 34 at the leading end portion of the piston lever of a cylinder actuator and which holds a middle portion of a standard-length straight tube P supplied from a shooter 5 by means of the aforementioned chuck 34 to feed it forward. Indicated at numeral 2 is an automatic bending-direction setting mechanism which is constructed of a link member 6 composed of support members 9 and 9' disposed in front of the automatic feed unit 1 and upper and lower parallel beams 7 and 7' hinged loosely to the support members 9 and 9'. The automatic bending-direction setting mechanism 2 is arranged upright at a right angle with respect to the straight tube P set in a horizontal direction, and receives and clamps the straight tube fed in a space, which is opened in the front face of its leading end portion, by means of a chuck 11 which is carried at the leading end portion of a guide wall 10 hinged to the middle portions of the support members 9 and 9' and in parallel with the upper and lower beams 7 and 7'. The chuck 11 is of the split type which is composed of a pair of blocks 12 and 12' hinged to the leading end portions of the guide wall 10 and formed with a clamping mouth 11' at its front on a line joining the hinge points of the upper and lower beams 7 and 7' and sloped faces opened to the back. Those blocks 12 and 12' are biased from each other by means of a spring (although not shown) in a direction to open the aforementioned clamping mouth 11'. With the guide wall 10, on the other hand, there engages a moving member 13 which is connected to an actuation source 36 constructed of an external cylinder actuator so that it can slide back and forth to have its leading end portion 14 pushing the sloped faces of the aforementioned chuck 11 thereby to shut off the clamping mouth 11' of said chuck and to hold the straight tube P firmly. Indicated at numerals 8 and 8' are hinge pins which are mounted in an apparatus frame. One hinge pin 8' is equipped with a pinion 15, which is associated with such a rack 17 as is attached to the piston lever of a cylinder actuator 16 acting as external actuation control means such that it can move back and forth. There is provided a cylindrical turn control member 19 which is connected directly to a separate motor $M_3$ for controlling the movement of said rack and which has a plurality of stopper members 18, 18' and so on anchored on its outer circumference. The aforementioned movement is controlled to set the bending direction of the link member 6 by the abutment of a projecting wall 20 on the side of the aforementioned rack 17 against desired one of the stopper members 18, 18' and so on corresponding to the positionings. Indicated at numerals 3 and 3' are a pair of automatic bending units which are disposed at both the sides of the link member 6. A shaping roll 25 has its core fixed to a stationary board 24' which is mounted on the leading end portion of an arm 24 hinged at 23 to a frame 22. A receiver 26 is fixed on the stationary board 24' in the vicinity of said shaping roll 25. Moreover, a bending roll 28 is hinged to the leading end portion of a bending arm 27 which is fixed at its base end portion to a hollow shaft made rotatable on the fixed core of the aforementioned shaping roll 25. A pinion 38 is fixed to the lower side of the aforementioned hollow shaft. Incidentally, the automatic bending units 3 and 3' are associated through pinions 38 with the pinions 34, respectively, which are in meshing engagement with longitudinally movable racks 30 mounted on the piston levers of cylinder actuators 29 acting as external actuation control means. At the same time, directly to a separate motor $M_2$ for controlling the movement of the aforementioned rack 30, there is connected a cylindrical turn control member 31 which has a plurality of stopper members 39, 39' and so on anchored on its outer circumference. The respective bending angles of the automatic bending units 3 and 3' are controlled by the abutment of the leading end portions of the aforementioned racks 30 against desired ones of the stopper members 39, 39' and so on in a manner to correspond to the positionings.

Figure 5:
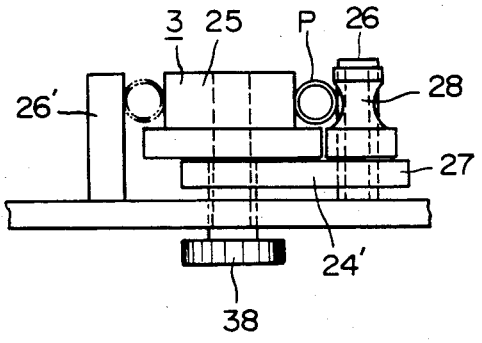
FIG. 5 is a side elevation showing an automatic bending unit of FIG. 1.

On the other hand, the automatic bending units 3 and 3' are associated with the frame 22 through a feed transmission chain 21, which is disposed in parallel with the straight tube P, so that it can move to the right and left and to and away from the aforementioned link member 6, and is equipped with separate cylinder actuators 37 so that they can move vertically on the aforementioned hinge pins 23. Indicated at numeral 32 is a cylinder actuator acting as external actuation control means for controlling the feed of said feed transmission chain 21. The cylinder actuator 32 has a feed controlling function by abutting against desired one of the stopper members 40, 40' and so on, which are anchored on the outer circumference of a cylindrical turn control member 33 connected directly to a motor $M_1$ through the leading end portion of the piston lever of said cylinder actuator 32 in a manner to correspond to the positionings of said turn control member 33. Incidentally, the bending units 3 and 3' are equipped, as shown in FIG. 5, with receivers 26 and 26' at both the sides of the shaping roll 25 to provide a mechanism (although not shown) for moving back and forth the bending units as a whole including the frame 22 so that the straight tube P may be set at either the front or rear side of the shaping roll 25 and may be bent from either the front or rear side by the bending roll 28 thereby to enlarge the range of the bending direction.

The aforementioned turn control members 19, 31 and 33 have their anchored stopper members 18, 18' and so on, 39, 39' and so on, and 40, 40' and so on corresponding in advance to the bending shapes so that they are made so easily removable that they can be exchanged for the different bending shapes. Indicated at numeral 4 is an automatic take-out unit which is constructed of a split type chuck 35 carried on the leading end portion of the piston lever of a cylinder actuator. Incidentally, arrows appearing in those Figures indicate the respective moving directions of the components.

The operations of the present invention thus constructed will be described in the following. First of all, when the standard-length straight tube P used as a work is fed forward from the shooter 5 while having its longitudinally substantial middle portion clamped by the chuck 34 of the automatic feed unit 1, it is automatically held firmly to end a first step by the opened standby chuck 11 of the link member 6 acting as the automatic bending-direction setting means 2 as the sloped open faces of the chuck are pushed by the leading end portion 14 of the moving member 13 as a result of the actuation of the actuation source 36.

Next, the feed transmission chain 21 is associated through the actuation of the actuation control means by the cylinder actuator 32 so that the frames 22 carrying the respective automatic bending units 3 and 3' are moved as a whole to the desired bending positions. By the actuations of the cylinder actuators 37, the aforementioned automatic bending units 3 and 3' are rocked upward to set the straight tube P among the shaping rolls 25, the receivers 26 and the bending rolls 28. Then, the cylinder actuators 29 acting as the external actuation control means are actuated to turn the bending rolls 28 together with the bending arms 27 around the shaping rolls 25 thereby to effect the bending operations. After this, the automatic bending units 3 and 3' are returned to their initial positions in association with the aforementioned cylinder actuators 29 to leave the straight tube P in accordance the downward rocking motions of the cylinder actuators 37. Next, in order to change and set the tube bending direction automatically, simultaneously as the actuation source 36 at the side of the automatic bending-direction setting means 2 constructed of the link member 6 is actuated, the link member 6 is moved in the folding direction by positioning the turning position of the turn control member 19. In accordance with this movement, the chuck 11 is turned at a desired angle, and the automatic bending units 3 and 3' are moved to their bending positions by the operations similar to the aforementioned ones. After the similar bending operations, the automatic bending units 3 and 3' are returned to their original positions. Then, the automatic bending units 3 and 3' are separated from the tube by the downward rocking movements of the cylinder actuators 37. Thus, the straight tube P is bent sequentially and repeatedly from both its ends around its clamped portion so that it is subjected to the desired bending operations to end a second step.

Next, after the end of all the bending operations, the bent product is taken out to the outside at a third step while being clamped by the chuck 35 of the automatic take-out unit 4 which is attached to the leading end portion of the piston lever of the separate cylinder actuator.

The operations of the aforementioned automatic bending-direction setting means 2 will be described in more detail in the following. When the straight tube P used as a work is fed to the chuck 11, the moving member 13 is slid forward in association with the actuation source 36 so that its leading end portion 14 pushes the sloped faces of the chuck 11 opened backward thereby to hold the straight tube P firmly in the clamping mouth 11'. Then, the cylinder actuator of the actuation control means 16 is moved forward until the rack 17 comes into abutment against the desired stopper member 18, 18' or the like, thereby to turn the pinion 15. As a result, in accordance with the rocking motions of the lower and upper beams 7' and 7 of the link member 6 in the directions of arrows, said link member 6 is displaced as a whole in the folding direction. At this instant, the chuck 11 at the leading end portion of the guide wall 10 of the link member 6 turns following those displacements to effect the set positions of the bending direction in association with the three-dimentional bending operations. Subsequent to this setting, the bending operations to the right and left are conducted sequentially around the clamped portion.

As has been described hereinbefore, the automatic metallic tube bending process and the apparatus therefor according to the present invention are constructed of: the aforementioned automatic feed unit 1; the automatic bending-direction setting means 2 including the link member 6 and having a changeable folding direction; the paired automatic bending units 3 and 3' disposed at both the right and left sides of the link member 6; and the automatic take-out unit 4, and all of these units and means are related and associated with one another. As a result, by the chuck 11 of the link member 6, the straight tube P is clamped at its longitudinally substantially middle portion to automatically set the turns of the tube in relation to the positioning of the bending direction for the bending operations and to effect the bending operations sequentially from both the ends of the tube so that the deviations of the two ends of the tube can be minimized when in the bending operations. Since the paired automatic bending units 3 and 3' disposed at the two right and left sides are so arranged that they can move apart from their set positions, moreover, the tube can have its circumference dented and damaged as little as possible as a result of its abutting and rubbing contact. At the same time, thanks to both the associated automations involving all the loading and taking-out operations and the shortened working time period resulting from the bending operations of the two right and left sides, the productivity can be remarkably improved. The limit to the length of the straight tube P is released so that the range of application of the present invention to the longer tube can be widened. When the product lots are to be rearranged for different bending shapes, moreover, this rearrangement can be easily effected merely by exchanging the turn control members 9, 31 and 33 which are constructed by anchoring the stopper members 18, 18' and so on, 39, 39' and so on, and 40, 40' and so on on the circumferences of the respective cylindrical members forming a component. As a result, there can be provided a remarkably useful automatic bending process and an apparatus therefor, which can be applied without any difficulty to the bending operations of a variety of tubes in each small number.

What is claimed is:

1. An apparatus for automatically bending a metallic tube, comprising:

feed means for sequentially feeding elongated tubes;

bending-direction setting means for clamping a tube fed from said feed means substantially centrally along the length of said tube, and for rotating the tube around the longitudinal axis of the gripped portion thereof, said bending direction setting means including a link assembly having a plurality of support members, a pair of parallel beams hinged loosely to each of said support members and a clamp pivotably connected to said support members for gripping the tube, said link assembly defining a plane disposed substantially at a right angle to the portion of the tube clamped by said bending direction setting means, said parallel beams each being pivotably mounted about hinge points disposed at respective locations thereon spaced from said support members for rotation within the plane of said link assembly;

means connected to at least one hinge point for rotating one of said parallel beams;

a pair of automatic bending means for bending the tube preselected amounts, said bending means being disposed on opposite sides of said bending direction setting means and being movable relative thereto; and removal means for removing a bent tube from said bending direction setting means, said removal means being selectively movable with respect to said bending direction setting means.

2. An apparatus as in claim 1 wherein the clamp is mounted to a guide disposed parallel to and intermediate said beams, said guide being hinged to said support members of said link assembly.

3. An apparatus as in claim 2 further comprising an external actuator, said external actuator being in communication with said guide of said bending direction setting means for moving said bending direction setting means generally parallel to the beams thereof and for moving the removal means into position to receive a bent tube from said clamp.

4. An apparatus as in claim 3 wherein the external actuator comprises at least one servo-motor.

5. An apparatus as in claim 1 wherein the feed means, the means for rotating the beam of said bending direction setting means, the benders and the removal means each comprise at least one hydraulic cylinder.

6. An apparatus for selectively setting the bending direction of a metallic tube bending apparatus comprising:

a support frame having a pair of spaced apart hinge pins;

a pair of elongated beams, each said beam having opposed first and second ends, the first ends of said beam being hinged respectively to the hinge pins of said frame;

a first support member hingedly connected to the respective second ends of said beams at spaced apart locations thereon such that said beams are substantially parallel to one another;

a second support member hingedly connected to said beams at locations on said beams intermediate the first and second ends thereof;

a guide hingedly connected to each of said first and second support members, said guide being disposed generally parallel to and intermediate said beams;

a clamp mounted to said guide, said clamp including a clamping portion for securely clamping a tube, said clamping portion being disposed between and substantially on a line joining the hinge pins of said frame;

means coupled to said clamp for selectively actuating said clamp; and means connected to one of sid beams for selectively rotating one of said beams about the respective hinge pin of the frame.

* * * * *